US006367456B1

(12) United States Patent
Barnes et al.

(10) Patent No.: US 6,367,456 B1
(45) Date of Patent: Apr. 9, 2002

(54) METHOD OF DETERMINING THE FUEL INJECTION TIMING FOR AN INTERNAL COMBUSTION ENGINE

(75) Inventors: Travis E. Barnes, Peoria, IL (US); Brian E. Uhlenhake, Frisco, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 08/283,099

(22) Filed: Jul. 29, 1994

(51) Int. Cl.[7] ..... F02M 37/04
(52) U.S. Cl. ..... 123/501; 123/179.17
(58) Field of Search ..... 123/501, 500, 123/446, 357, 179.17

(56) References Cited

U.S. PATENT DOCUMENTS

| | | | | | |
|---|---|---|---|---|---|
| 4,368,705 | A | | 1/1983 | Stevenson et al. | 123/357 |
| 4,463,733 | A | * | 8/1984 | Tsai | 123/501 |
| 4,722,310 | A | * | 2/1988 | Igashira | 123/501 |
| 4,870,939 | A | | 10/1989 | Ishikawa et al. | 123/506 |
| RE33,270 | E | | 7/1990 | Beck et al. | 123/447 |
| 5,024,200 | A | * | 6/1991 | Free | 123/381 |
| 5,143,291 | A | | 9/1992 | Grinsteiner | 239/88 |
| 5,152,266 | A | | 10/1992 | Sekiguchi et al. | 123/357 |
| 5,168,855 | A | | 12/1992 | Stone | 123/446 |
| 5,176,115 | A | | 1/1993 | Campion | 123/179.17 |
| 5,181,494 | A | | 1/1993 | Ausman et al. | 123/446 |
| 5,191,867 | A | | 3/1993 | Glassey | 123/446 |
| 5,243,947 | A | * | 9/1993 | Yamamoto | 123/501 |
| 5,245,970 | A | | 9/1993 | Iwaszkiewicz et al. | 123/447 |
| 5,261,374 | A | * | 11/1993 | Gronenberg | 123/436 |
| 5,313,924 | A | | 5/1994 | Regueiro | 123/456 |
| 5,357,912 | A | * | 10/1994 | Barnes | 123/381 |

OTHER PUBLICATIONS

SAE Paper No. 930270, "HEUI—A New Direction for Diesel Engine Fuel Systems", Glassey et al., International Congress and Exposition, Detroit, MI., Mar. 1–5, 1993.

SAE Paper No. 930271, "Development of the HEUI Fuel System—Integration of Design, Simulation, Test, and Manufacturing", Stockner et al., International Congress and Exposition, Detroit, MI., Mar. 1–5, 1993.

SAE Paper No. 940586, Benefits of New Fuel Injection System Technology on Cold Startability of Diesel Engines—Improvement of Cold Startability and White Smoke Reduction by Means of Multi Injection With Common Rail Fuel System (ECD–U2), Osuka et al., International Congress and Exposition, Detroit, MI., Feb. 28–Mar. 3, 1994.

Exhibit A—Statement of Facts.

Exhibit B—Dated Oct. 16, 1992—Field Test Agreement with Brenham Wholesale Grocery.

Exhibit C—Dated Jan. 4, 1993—Field Test Agreement with Wyoming Dept. of Transportation.

Exhibit D—Dated Jan. 26, 1993—Field Test Agreement with Ryder.

* cited by examiner

*Primary Examiner*—Carl S. Miller
(74) *Attorney, Agent, or Firm*—David M. Masterson; Byron G. Buck; Michael B. McNeil

(57) ABSTRACT

In one aspect of the present invention, a method is disclosed for controlling the timing at which fuel is to be injected. In response to engine speed and temperature, a desired timing signal is produced. The desired timing angle represents when the start of injection is to occur in order to cause combustion at substantially Top Dead Center (TDC). The timing signal additionally accounts for a predetermined ignition delay from the time that fuel is injected to the start of combustion.

6 Claims, 3 Drawing Sheets

METHOD OF DETERMINING THE FUEL INJECTION TIMING FOR AN INTERNAL COMBUSTION ENGINE

FIELD OF THE INVENTION

This invention relates generally to a method for determining the fuel injection timing for an internal combustion engine and, more particularly, to a method for determining the fuel injection timing for an internal combustion engine during starting.

BACKGROUND ART

A diesel engine achieves combustion by injecting fuel that vaporizes into the hot air of an engine cylinder. However, during cold starting conditions, the air loses much of its heat to the cylinder walls making engine starting difficult. For example, if fuel is injected into the cylinder too soon, the cold fuel cools the air charge preventing combustion temperatures from occurring. If fuel is injected too late, much of the fuel will not used in the combustion.

The maximum cylinder temperature and pressure should occur at Top Dead Center (TDC). Therefore, it is desirable to inject fuel into the cylinder slightly before TDC where air temperature is at a maximum to improve combustibility. As engine speed increases, the fuel injection timing should be increased to achieve optimum combustion.

The present invention is directed to overcoming one or more of the problems as set forth above.

DISCLOSURE OF THE INVENTION

In one aspect of the present invention, a method is disclosed for controlling the timing at which fuel is to be injected. In response to engine speed and temperature, a desired timing signal is produced. The desired timing angle represents when the start of injection is to occur in order to cause combustion at substantially Top Dead Center (TDC). The timing signal additionally accounts for a predetermined ignition delay from the time that fuel is injected to the start of combustion.

BRIEF DESCRIPTION OF THE DRAWINGS

For a better understanding of the present invention, reference may be made to the accompanying drawings in which.

BEST MODE FOR CARRYING OUT THE INVENTION

The present invention relates to an electronic control system for use in connection with a hydraulically actuated electronically controlled unit injector fuel system. Hydraulically actuated electronically controlled unit injector fuel systems are known in the art. One example of such a system is shown in U.S. Pat. No. 5,191,867, issued to Glassey on Mar. 9, 1993, the disclosure of which is incorporated herein by reference.

Figure 1:
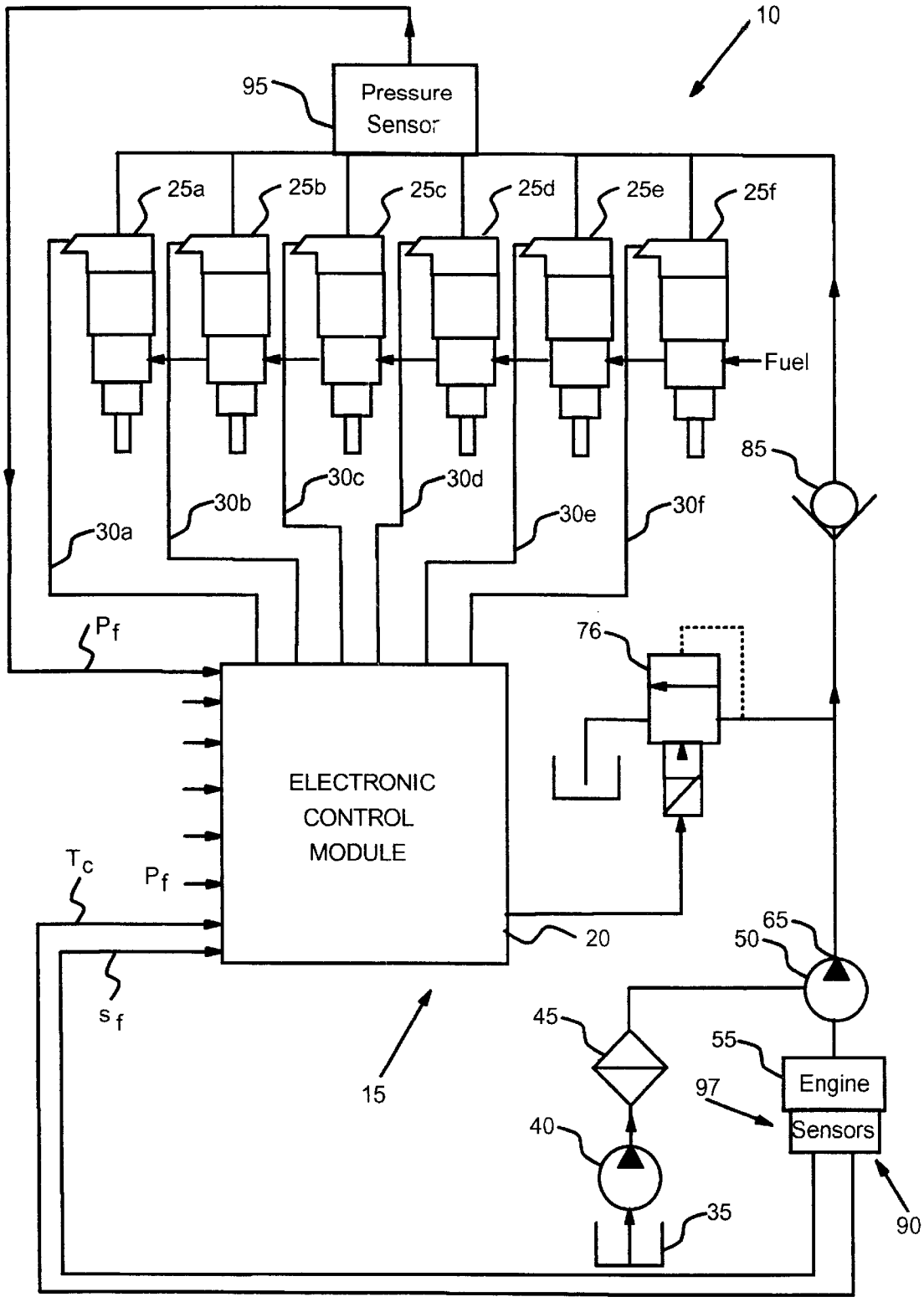
FIG. 1 is a diagrammatic general schematic view of a hydraulically-actuated electronically-controlled injector fuel system for an engine having a plurality of injectors.

Throughout the specification and figures, like reference numerals refer to like components or parts. Referring first to FIG. 1, a preferred embodiment of the electronic control system 10 for a hydraulically actuated electronically controlled unit injector fuel system is shown, hereinafter referred to as the HEUI fuel system. The control system includes an Electronic Control Module 15, hereinafter referred to as the ECM. In the preferred embodiment the ECM is a Motorolla microcontroller, model no. 68HC11. However, many suitable controllers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment the actuating fluid comprises engine oil and the oil supply is the engine oil pan 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 76, hereinafter referred to as the IAPCV. Other devices, which are well known in the art, may be readily and easily substituted for the fixed displacement pump 50 and the IAPCV. For example, one such device includes a variable pressure high displacement pump.

In a preferred embodiment, the IAPCV and the fixed displacement pump 50 permits the ECM to maintain a desired pressure of actuating fluid. A check valve 85 is also provided.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector 25.

The electronic control uses several sensors, some of which are shown. An engine speed sensor 90 reads the signature of a timing wheel applied to the engine camshaft to indicate the engine's rotational position and speed to the ECM. An actuating fluid pressure sensor 95 delivers a signal to the ECM to indicate the actuating fluid pressure. Moreover, an engine coolant temperature sensor 97 delivers a signal to the ECM to indicate engine temperature.

Figure 2:
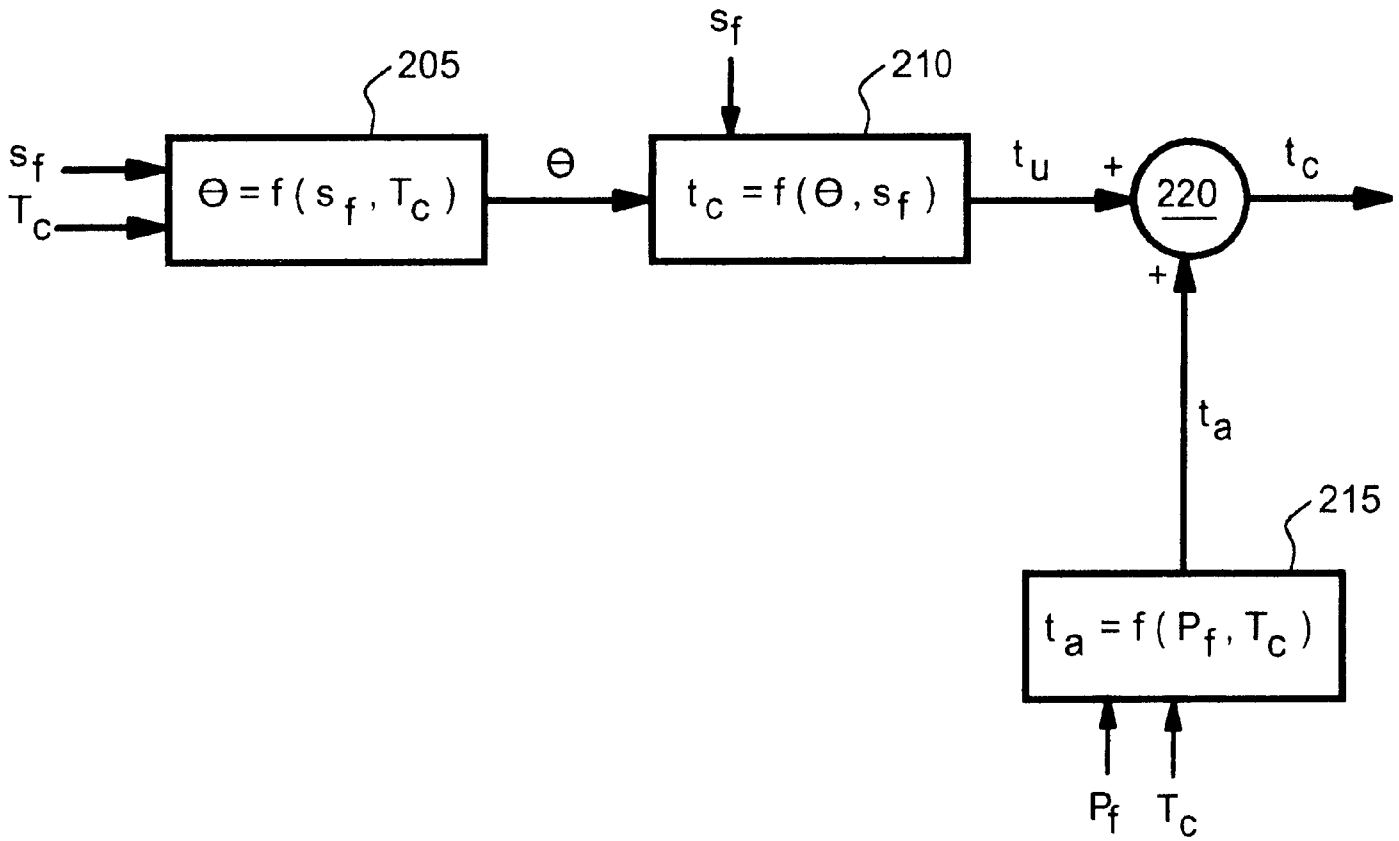
FIG. 2 is a block diagram of a fuel injection timing control strategy for the fuel system of FIG. 1.

The software decision logic for determining the magnitude of fuel injection timing is shown with respect to FIG. 2. The engine speed and coolant temperature are sensed and their respective signals ($s_f$,$T_c$) are delivered to block 205, which produces a desired timing angle signal θ based on a map(s) and/or equation(s). The timing angle signal θ represents when fuel injection is desired to occur Before Top Dead Center (BTDC). Advantageously, the magnitude of the timing angle signals accounts for an ignition delay from the time fuel is injected to the start of combustion. This ignition delay is responsive to the air temperature and pressure within the engine cylinder. Note, because the cylinder air temperature is proportional to the cylinder air pressure, only the air temperature is measured. Accordingly, because the engine coolant temperature may readily be sensed, the engine coolant temperature is used to approximate the cylinder air temperature.

The timing angle signal θ, along with, the actual engine speed signal sf is delivered to block 210, which converts the timing angle signal θ into an equivalent uncorrected time delay signal $t_u$. The magnitude of the uncorrected time delay signal $t_u$ is adjusted by block 220 (increased or decreased) in response to the magnitude of an adjusting time delay signal $t_a$. The adjusting time delay signal $t_a$ is produced by block 215, which includes map(s) and/or equations which reflect the timing characteristics of the hydraulically-actuated injector 25 to changes in the actuating fluid pressure and viscosity. More particularly, the map(s) reflects the time delay from the time that current is applied to the injector solenoid to the time that fuel is dispensed from the injector. Note, because the actuating fluid viscosity is difficult to measure, the engine coolant temperature is used to approximate the actuating fluid temperature—which is proportional to actuating fluid viscosity. Accordingly, block 215 produces the adjusting time delay signal $t_a$ in response to receiving signals representing the actuating fluid pressure and engine coolant temperature ($P_f$,$T_c$). The resulting equivalent time delay signal $t_c$ is used by the ECM to determine when to send current (I) to the solenoid of a respective injector 25 to initiate fuel injection.

Thus, while the present invention has been particularly shown and described with reference to the preferred embodiment above, it will be understood by those skilled in the art that various additional embodiments may be contemplated without departing from the spirit and scope of the present invention.

Industrial Applicability

Typically, engine starting includes three engine speed ranges. For example, from 0–200 RPM the engine is said to be cranking (cranking speed range). Once the engine fires, then the engine speed accelerates from engine cranking speeds to engine running speeds (acceleration speed range). Once the engine speed reaches a predetermined engine RPM, e.g. 900 RPM, then the engine is said to be running (running speed range). The present invention is concerned with controlling fuel injection timing to start an engine—especially where the engine temperature is below a predetermined temperature, e.g. 18° Celsius. It is desired that combustion occur at TDC for optimum engine performance. Advantageously, the present invention determines a desired ignition timing, which accounts for an ignition delay, to achieve combustion at TDC.

Figure 3:
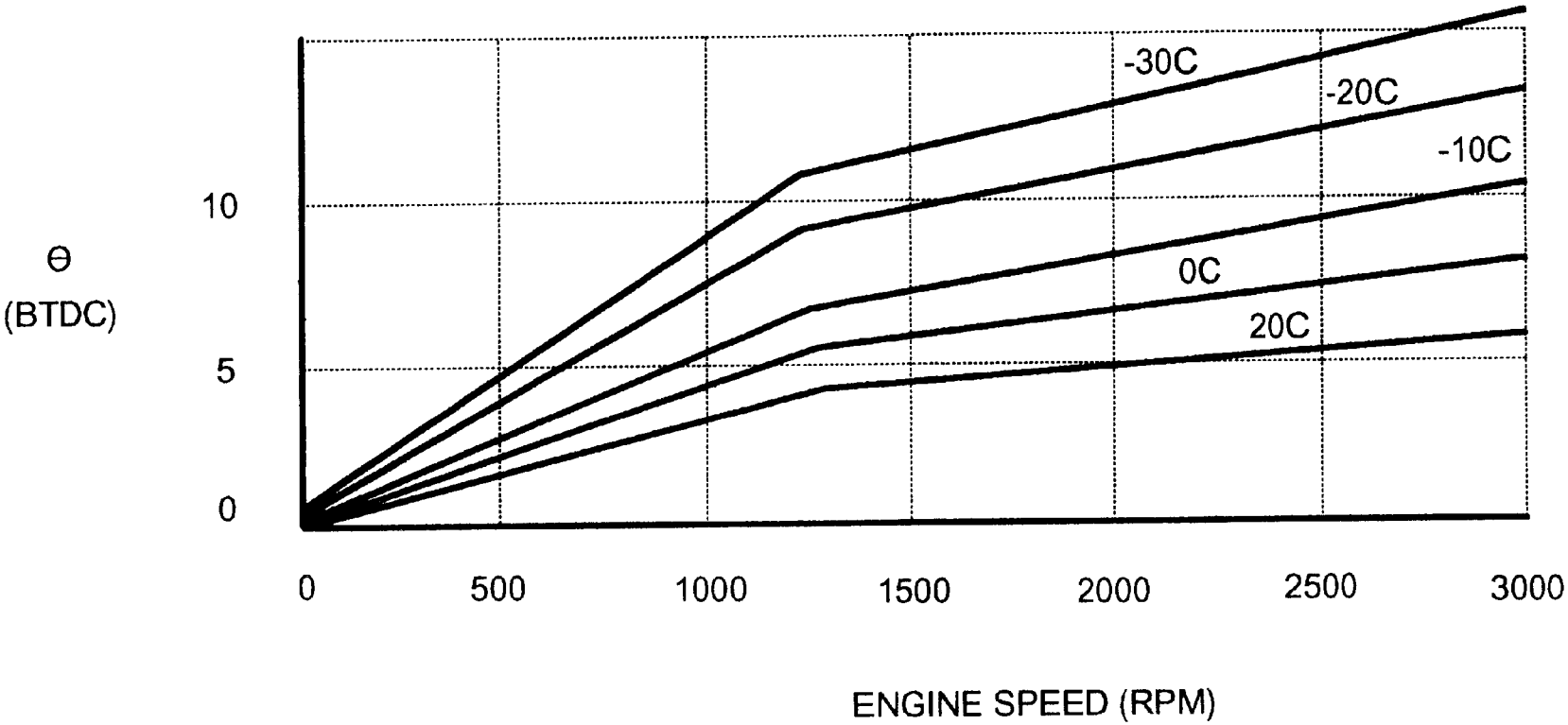
FIG. 3 is a timing map for selecting a desired fuel injection timing as a function of engine speed and temperature.

Reference is now made to FIG. 3, which illustrates an exemplary map that may be utilized by block 205. As shown, for a predetermined engine speed and temperature, a desired timing angle is selected. The desired timing angle magnitude includes a predetermined ignition delay that corresponds to the predetermined temperature.

FIG. 3 shows that up until about 900 RPM, the desired timing angle ranges from 0° to about 5°; and more particularly, at cranking speeds the desired timing angle ranges from 0° to 3°. After 900 RPM the engine is considered to be running, so the desired timing angle is advanced proportional to engine speed to ensure that combustion occurs at TDC.

It is noted that, the map shown in FIG. 3 is merely illustrative and the actual values of the map may vary depending on the actuating fluid viscosity and the dynamics of the fuel injector.

Other aspects, objects and advantages of the present invention can be obtained from a study of the drawings, the disclosure and the appended claims.

What is claimed is:

1. A method for electronically controlling the timing of fuel injection to start an internal combustion engine (55), comprising the steps of:

sensing the temperature of the engine (55) and producing a temperature signal ($T_c$) indicative of the sensed engine temperature;

sensing the engine speed and producing an engine speed signal ($S_f$) indicative of a magnitude of the sensed engine speed; and receiving the engine speed and temperature signals, determining the start of injection to cause combustion at substantially Top Dead Center (TDC) based on the magnitude of the engine speed and temperature, and producing a timing angle signal (θ) representing when fuel is to be injected relative to (TDC), wherein the magnitude of the timing angle signal (θ) includes a predetermined ignition delay from the time that fuel is injected to the start of combustion.

2. A method, as set forth in claim 1, including the step of producing a timing angle signal (θ) having a magnitude in the of range from 0° to 3° Before Top Dead Center (BTDC) in response to the engine temperature being below a predetermined temperature and engine cranking speeds.

3. A method, as set forth in claim 2, including the step of increasing the magnitude of the timing angle signal (θ) to advance the timing of injection in response to the engine speed accelerating.

4. A method, as set forth in claim 1, including the steps of receiving the timing angle and engine speed signals (θ, $s_f$), converting the timing angle signal into a corresponding time delay based on the magnitude of the timing angle and engine speed signals (θ, $s_f$), and producing an uncorrected time delay signal ($t_u$) indicative of the magnitude of the time delay.

5. A method, as set forth in claim 4, including the steps of:

sensing the pressure of actuating fluid used to hydraulically actuate the injector and producing an actuating fluid pressure signal ($P_f$) indicative of the sensed actuating fluid pressure; and receiving the actuating fluid pressure and engine temperature signal ($P_f$,$T_c$) and determining a time delay adjustment based on the magnitude of the actuating fluid pressure and engine temperature, and producing a time delay adjusting signal ($t_a$) indicative of the magnitude of the time delay adjustment.

6. A method, as set forth in claim 5, including the steps of:

receiving the uncorrected and adjusting time delay signals ($t_a$,$t_u$), summing the magnitudes of the uncorrected and adjusting time delay signals, and producing a corrected time delay signal ($t_c$) indicative of the time in which the injector is to initiate fuel injection.

* * * * *